US005856023A

United States Patent [19]

Chen et al.

[11] Patent Number: 5,856,023

[45] Date of Patent: Jan. 5, 1999

[54] INK JET RECORDING SHEET

[75] Inventors: Yung T. Chen, Lexington; Gerald P. Harwood, Jr., Billerica; Michael S. Viola, Burlington, all of Mass.

[73] Assignee: Polaroid Corporation, Cambridge, Mass.

[21] Appl. No.: 779,802

[22] Filed: Jan. 7, 1997

[51] Int. Cl.[6] ..... B41M 5/00

[52] U.S. Cl. ..... 428/520; 428/195; 428/520

[58] Field of Search ..... 428/195, 520, 428/500

[56] References Cited

U.S. PATENT DOCUMENTS

| | | | |
|---|---|---|---|
| 4,340,522 | 7/1982 | Bronstein-Bonte et al. | 524/766 |
| 4,425,405 | 1/1984 | Murakami et al. | 428/342 |
| 4,460,637 | 7/1984 | Miyamoto et al. | 428/212 |
| 4,474,850 | 10/1984 | Burwasser | 428/336 |
| 4,503,118 | 3/1985 | Murakami et al. | 428/323 |
| 4,547,405 | 10/1985 | Bedell et al. | 427/256 |
| 4,575,465 | 3/1986 | Viola | 427/261 |
| 4,592,951 | 6/1986 | Viola | 428/323 |
| 4,592,954 | 6/1986 | Malhotra | 428/335 |
| 4,794,067 | 12/1988 | Grasshoff et al. | 430/213 |
| 4,877,678 | 10/1989 | Hasegawa et al. | 428/216 |
| 4,900,620 | 2/1990 | Tokita et al. | 428/330 |
| 4,904,519 | 2/1990 | Newman | 428/203 |
| 4,956,230 | 9/1990 | Edwards et al. | 428/341 |
| 5,126,193 | 6/1992 | Light | 428/327 |
| 5,139,867 | 8/1992 | Light | 428/327 |
| 5,171,626 | 12/1992 | Nagamine | 428/212 |
| 5,194,317 | 3/1993 | Sato et al. | 428/195 |
| 5,212,008 | 5/1993 | Malhotra et al. | 428/216 |
| 5,302,437 | 4/1994 | Idei et al. | 428/195 |
| 5,330,824 | 7/1994 | Takimoto et al. | 428/201 |
| 5,342,688 | 8/1994 | Kitchin et al. | 428/402 |
| 5,403,955 | 4/1995 | Farooq | 564/15 |
| 5,439,739 | 8/1995 | Furukawa et al. | 428/341 |
| 5,478,631 | 12/1995 | Kawano et al. | 428/500 |
| 5,560,982 | 10/1996 | Sato | 428/216 |

FOREIGN PATENT DOCUMENTS 57-182445 11/1982 Japan .

*Primary Examiner*—Pamela R. Schwartz
*Attorney, Agent, or Firm*—David J. Cole

[57] ABSTRACT

An ink jet recording sheet comprises a support carrying an ink-receiving layer, this layer comprising a mixture of a derivatized (preferably acetoacetylated) poly(vinyl alcohol) and a non-derivatized poly(vinyl alcohol). The ink-receiving layer preferably also comprises a poly(vinylbenzyl quaternary ammonium salt) and poly(vinylpyrrolidone).

13 Claims, No Drawings

INK JET RECORDING SHEET

REFERENCE TO RELATED APPLICATION

Attention is directed to our copending application Ser. No. 08/780,475, of even date herewith, entitled "Ink Jet Recording Sheet", assigned to the same assignee as the present application. This application describes and claims an ink jet recording sheet and method using a sheet having an ink receiving layer comprising a hydrophilic polymer and a specific type of poly(vinylbenzyl quaternary ammonium salt).

BACKGROUND OF THE INVENTION

This invention relates to an ink jet recording sheet which is intended to be printed by an ink jet printer.

Ink jet printers, that is to say printers which form an image by firing a plurality of discrete drops of ink from one or more nozzles on to the surface of a recording sheet placed adjacent the nozzles, have recently enjoyed a large increase in sales. Such ink jet printers have the advantage that they can reproduce good quality text and images, in both monochrome and full color, can produce both reflection prints and transparencies, and are relatively inexpensive to manufacture and to operate, as compared with, for example, color laser printers, thermal wax transfer printers and dye sublimation printers. Accordingly, ink jet printers now dominate the home/small office market, and are often also used to provide color capability not available from the monochrome laser printers typically employed in larger offices.

Although modern ink jet printers can print on almost any conventional paper or similar medium, and indeed are routinely used with commercial photocopying paper for printing text, the quality of images produced by such printers is greatly affected by the properties of the medium used. To produce high quality images reliably, it is necessary that the medium (ink jet recording sheet) used rapidly absorb the ink, in order that the ink does not remain wet for an extended period, since otherwise the ink is likely to smear when successive sheets are stacked in the output tray of the printer. On the other hand, the medium should not promote excessive spreading of the ink droplet, since such spreading reduces image resolution and may result in color distortion if adjacent ink droplets intermix. The medium also should not promote "wicking", that is to say spreading of ink by capillary action through fibrous media, such as paper. The medium must be capable of absorbing the ink without substantial distortion of the medium, since otherwise unsightly "cockling" (formation of ripples and similar folds) may occur, and most observers find such distortions unacceptable. Once the ink has dried, the medium should be such that contact of the image with moist surfaces (such as sweaty fingers) does not result in bleeding of ink from the image. Finally, since the surface characteristics, such as smoothness, glossiness and feel, of the image are largely determined by the same characteristics of the medium, the medium should possess characteristics appropriate to the type of image being printed. When, as is increasingly common, an ink jet printer is used to print a digital image produced by a camera or a scanner, the medium should be smooth and possess the high gloss and smooth feel of conventional silver-halide based photographic printing paper.

It is difficult to reconcile all these demands upon an ink jet printing medium and, as shown by the literature, much research has been dedicated to improving such media. For example, U.S. Pat. No. 4,592,951 describes an ink jet recording sheet comprising a transparent support carrying a layer of cross-linked poly(vinyl alcohol). U.S. Pat. No. 4,575,465 describes an ink jet recording sheet comprising a transparent support carrying a layer formed from a mixture of vinylpyridine/vinylbenzyl quaternary ammonium salt copolymer and a hydrophilic polymer selected from the group consisting of gelatin, poly(vinyl alcohol), and hydroxypropyl cellulose, and mixtures thereof. U.S. Pat. No. 4,547,405 describes an ink jet recording sheet comprising a transparent support carrying a layer comprising a mixture of a coalesced block copolymer latex of poly(vinyl alcohol) with polyvinyl(benzyl ammonium chloride) and a water-soluble polymer selected from the group consisting of poly(vinyl alcohol), poly(vinylpyrrolidone) and copolymers thereof.

U.S. Pat. No. 4,904,519 describes an ink jet recording sheet comprising a transparent polymeric backing having on at least one major surface thereof a transparent, ink-receptive layer comprising a cross-linked, hydrolyzed copolymer of a vinyl ester comonomer selected from the group consisting of vinyl acetate, vinyl propionate and vinyl stearate, and a vinyl amide comonomer selected from the group consisting of N-vinyl pyrrolidone and vinyl acetamide, the degree of hydrolysis being from about 80 to 95%, and the cross-linking being effected by an agent selected from the group consisting of borates, titanates, dichromates and aldehydes.

U.S. Pat. No. 4,900,620 describes an ink jet recording sheet including a sheet-like substrate composed mainly of 70 to 100 wt % of wood pulp and 0 to 30 wt % of precipitated calcium carbonate and having a Stockigt sizing degree of not less than 2 seconds and not more than 25 seconds when formed into a sheet having a basis weight of 64 g/m$^2$, and a coating layer composed mainly of white pigment, with the coating layer being formed on at least one side of the substrate at a weight of 1 to 10 g/m$^2$. According to this patent, this sheet has a high ink absorption rate and is able to develop bright colors and sharp images.

U.S. Pat. No. 5,139,867 describes transparent image-recording elements that contain ink-receptive layers that can be imaged by the application of liquid ink dots. The ink-receptive layers contain a combination of:

(i) a vinyl pyrrolidone;

(ii) particles of a polyester, namely a poly (cyclohexylenedimethylene-co-oxydiethylene isophthalate-co-sodio-sulfobenzenedicarboxylate);

(iii) a homopolymer or a copolymer of an alkylene oxide containing from 2 to 6 carbon atoms;

(iv) a polyvinyl alcohol;

(v) a compound or a mixture of compounds having the general formula $$R_2O(CHR_1CH_2O)_nR_3$$

wherein $R_1$ represents a hydrogen atom or a methyl group, $R_2$ and $R_3$ each represent a hydrogen atom, an alkyl group having a carbon number of 1 to 4 or a phenyl group, and n is an integer of 1 to 10; and (vi) inert particles.

U.S. Pat. No. 4,592,954 describes a transparency for ink jet printing comprised of a supporting substrate and thereover a coating consisting essentially of a blend of carboxymethyl cellulose, and polyethylene oxides. Also disclosed are papers for use in ink jet printing comprised of a plain paper substrate and a coating thereover consisting essentially of polyethylene oxides.

U.S. Pat. No. 5,342,688 describes an ink-receptive sheet comprising a transparent substrate bearing on at least major surface thereof an ink-receptive layer which comprises at least one imaging polymer and an effective amount of polymeric mordant, which comprises a polymethylene backbone carrying pendant aminoguanidino groups.

It has now been found that the properties of ink jet recording sheets having ink-receiving layers which contain poly(vinyl alcohol) can be improved by using as the poly (vinyl alcohol) a mixture of derivatized and non-derivatized poly(vinyl alcohol)

SUMMARY OF THE INVENTION

Accordingly, this invention provides an ink jet recording sheet comprising a support carrying an ink-receiving layer, this ink-receiving layer comprising a non-derivatized poly (vinyl alcohol) and a derivatized poly(vinyl alcohol).

This invention also provides a method of ink jet printing which comprises applying to an ink jet recording sheet a plurality of ink droplets generated from an ink jet printer, wherein the ink jet recording sheet comprises a support carrying an ink-receiving layer, this ink-receiving layer comprising a non-derivatized poly(vinyl alcohol) and a derivatized poly(vinyl alcohol), the ink droplets being applied to the ink-receiving layer.

DETAILED DESCRIPTION OF THE INVENTION

The derivatized poly(vinyl alcohol) used in the ink jet recording sheet of the present invention differs from conventional (also, for convenience referred to herein as "underivatized") poly(vinyl alcohol) in that at least some of the hydroxyl groups present in the underivatized poly(vinyl alcohol) are replaced by ether or ester groupings, preferably the latter. A preferred type of derivatized poly(vinyl alcohol) for use in the present invention is an acetoacetylated poly (vinyl alcohol), in which the hydroxyl groups are esterified with acetoacetic acid. Acetoacetylated poly(vinyl alcohol) is available commercially, for example as Gohsefimer Z-200, sold by Nippon Gohsei, No. 9-6, Nozaki-cho, Kita-ku, Osaka, Japan. This material is stated by the manufacturer to be a super hydrolyzed poly(vinyl alcohol) having a degree of hydrolysis of 99–100%, a viscosity in 4% aqueous solution at 20° C. of 13.3–14.3 cps and a pH in the same solution of 3.5–5.

A preferred underivatized poly(vinyl alcohol) for use in the present ink jet recording sheet is Airvol-205, sold by Air Products, Allentown, Pa. This material is stated by the manufacturer to be a partially hydrolyzed poly(vinyl alcohol) having a degree of hydrolysis of 87–89%, a viscosity in 4% aqueous solution at 20° C. of 5.2–6.2 cps and a pH in the same solution of 4.5–6.5.

It is important to use a mixture of derivatized and underivatized poly(vinyl alcohol) in the present ink jet recording sheet, since it has been found that the mixture has better ink absorbing characteristics than either component alone. Although the optimum mixture (which skilled persons can determine by routine empirical testing) will vary somewhat depending upon the particular derivatized and underivatized poly(vinyl alcohol)s used, in general it is preferred that the weight ratio of the non-derivatized poly (vinyl alcohol) to the derivatized poly(vinyl alcohol) in the ink-receiving layer be in the range of from about 2:1 to about 1:2; in some cases, uses of approximately equal weights of the two polymers gives the best results.

To produce an ink-receiving layer of optimum toughness and control of ink spreading, it is desirable that the poly (vinyl alcohol) be cross-linked. Such cross-linking may be effected with any of the known cross-linking agents for poly(vinyl alcohol), for example the boron compounds and chromium chloride described in the aforementioned U.S. Pat. No. 4,592,951. However, preferably the cross-linking agent is an aldehyde In addition to the derivatized and underivatized poly(vinyl alcohol)s, the ink-receiving layer of the present ink jet recording sheet also desirably comprises a mordant to improve the ink binding ability of the layer. Preferred mordants for this purpose are poly(vinylbenzyl quaternary ammonium salts), especially those of the formula:

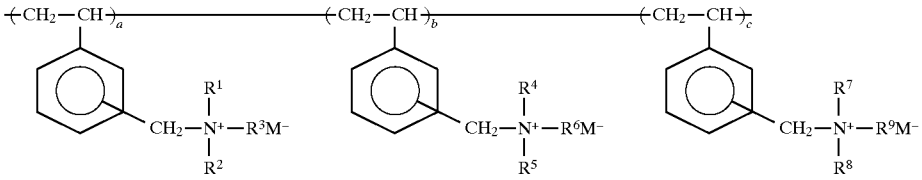

wherein each of $R^1$, $R^2$, $R^3$, $R^4$, $R^5$ and $R^6$ is independently alkyl of from 1 to 4 carbon atoms; each of $R^7$, $R^8$ and $R^9$ is independently alkyl of from 1 to 18 carbon atoms and the total number of carbon atoms in $R^7$, $R^8$ and $R^9$ is from 13 to 20; each $M^-$ is an anion; and each of a, b and c is the molar proportion of the respective repeating units. These mordants, and processes for their preparation, are described in U.S. Pat. No. 4,794,067, which also claims image-receiving elements containing these mordants. A specific preferred mordant of this type is that in which each of $R^1$, $R^2$, $R^3$, $R^7$ and $R^8$ is a methyl group; each of $R^4$, $R^5$ and $R^6$ is an ethyl group; and $R^9$ is an n-$C_{12}H_{25}$ group; for convenience, this material is referred to in the Example below simply as "Terpolymer".

In addition to the derivatized and underivatized poly(vinyl alcohol) and the mordant, the ink-receiving layer also advantageously comprises poly(vinyl pyrrolidone); this polymer acts to control ink reception by the ink-receiving layer and to control dot spread, i.e., the tendency for the ink droplets to spread laterally across the sheet. This polymer also improves the gloss of the sheet, producing a sheet with an appearance closely resembling that of conventional silver-halide based photographic printing paper. It is also advantageous to include starch granules in the ink-receiving layer in order that the feel of the sheet will closely resemble that of photographic printing paper. Finally, it has been found that including a surfactant in the ink-receiving layer further improves the ability of the layer to control dot spread; linear alkoxylated fatty alcohol surfactants, such as that sold commercially by BASF, Parsippany, N.J., under the trade name Plurafac C17, are preferred for this purpose.

In preparing an ink jet recording sheet, it is necessary to consider not only the ink-receiving properties of the sheet, but also its mechanical properties. Most ink jet printers intended for home or small office use have an input tray for recording sheets at the front of the printer. Sheets withdrawn from this tray are carried 180° around a roller or roller assembly and thence across a platen, above which one or more ink jet heads reciprocate to effect printing. The sheets are carried from the platen to an output tray positioned vertically above the input tray; typically, movable support members are provided on the output tray to hold a sheet emerging from the platen above the output tray for a few seconds, in order to prevent the sheet still "wet" from printing coming into contact with the preceding sheet and thus avoid smearing of the image on either sheet. Because of space constraints in the printer, the roller or roller assembly is usually only about 4 cm in diameter, and the recording sheet must be able to be wrapped around that small diameter without acquiring a permanent "set", so that the sheet will lie flat on the platen and in the output tray. It has been found advantageous to include a minor proportion of a poly(alkyl acrylate) or a poly(alkyl methacrylate) in the ink-receiving layer to improve the sheet feeding properties of the medium, poly(methyl methacrylate) being especially preferred for this purpose.

The proportions of the various components in the ink receiving layer may vary over a considerable range, but persons skilled in the art of preparing ink jet recording media will be able to determine the optimum proportions for any specific formulation by routine empirical tests. By way of general guidance, it may be stated that the ink-receiving layer may typically comprise:

- from about 20 to about 40 parts by weight of a non-derivatized poly(vinyl alcohol);
- from about 20 to about 40 parts by weight of an acetoacetylated poly(vinyl alcohol);
- from about 5 to about 15 parts by weight of an a poly(vinylbenzyl quaternary ammonium salt);
- from about 15 to about 30 parts by weight of poly (vinylpyrrolidone);
- from 0 to about 5 (most desirably about 2) parts by weight of a poly(alkyl acrylate) or poly(alkyl methacrylate); and
- from 0 to about 1 (most desirably about 0.2) part by weight of a surfactant.

If the layer contains starch, the starch will typically be in an amount of from about 2 to about 8 parts by weight.

In addition to the components discussed above, the ink-receiving layer may comprise various conventional additives, for example ultraviolet absorbers, antioxidants, humectants, bactericides, fungicides and cross-linking agents.

The support employed in the present invention is not critical, and will normally be chosen having regard to the type of image which is intended to be produced, the proposed use of the image and the specific ink employed. The support may be transparent or opaque, depending upon whether a transparency or reflection print is desired. Polymeric films of both synthetic and naturally occurring polymeric materials may be employed. Examples of suitable transparent polymeric materials include polymethacrylic acid; methyl and ethyl esters; polyamides, such as nylons; polyesters, such as the polymeric films derived from ethylene glycol terephthalate acid; polymeric cellulose derivatives; polycarbonates; polystyrene and the like. Non-transparent supports include paper and synthetic papers such as silica-based synthetic papers. To promote adhesion of the ink-receiving layer to the support, subcoats or surface treatments of the support, such as corona discharge, may be employed.

The ink jet recording sheet of the present invention is primarily intended for use with aqueous and alcohol based inks, although we do not exclude the possibility that the sheet may be useful in conjunction with inks based upon hydrophobic organic solvents such as hydrocarbons.

The ink jet recording sheet of the present invention can be prepared by conventional coating techniques. As illustrated in Example 1 below, typically the various components of the ink-receiving layer will be prepared in the form of an aqueous solution or dispersion, coated on to the desired support and dried to produce the final recording sheet.

The following Examples are now given, though by way of illustration only, to show particularly preferred reagents, conditions and techniques used in preparing the ink jet recording sheet of the present invention.

EXAMPLE 1

A dispersion was formed from the following components; all parts by weight are quoted on a dry solids basis:

| | Parts by weight |
|---|---|
| Underivatized poly(vinyl alcohol) (Airvol 205) | 33.0 |
| Acetoacetylated poly(vinyl alcohol) (Z200) | 32.8 |
| Terpolymer | 10.0 |
| Poly(vinyl pyrrolidone) | 22.0 |
| Poly(methyl methacrylate) | 2.0 |
| Surfactant (Plurafac C17) | 0.2 |

To prepare the dispersion, 115.5 grams of a 20 weight percent aqueous solution of Airvol 205, 287 grams of an 8 weight percent aqueous solution of Z200, and 55.6 grams of a 12.6 weight percent aqueous solution of terpolymer were added to 313 grams of water, and mixed in a air-driven mixer for 30 minutes. The surfactant (1.4 grams of a 10 weight percent aqueous solution), poly(methyl methacrylate) (35 grams of a 4 weight percent aqueous dispersion) and the poly(vinyl pyrrolidone) (192.5 grams of an 8 weight percent aqueous solution) were then added, and the resultant mixture mixed for a further 30 minutes to produce a dispersion suitable for coating.

The dispersion thus produced was coated on to 7.6 mil polyclad photo paper using a #24 Mayer rod at a coating weight of 4.2 g/m$^2$, and the coated sheets were dried at 80° C. in an oven for 10 minutes. The dried ink jet recording sheets were tested using a Lexmark 2050 printer and were found to give excellent color images with minimal ink spread and smearing. Also, the printed sheets had a gloss and feel closely resembling that of conventional silver-halide based photographic printing paper. To test waterfastness, the printed images were placed into a beaker of deionized water for three minutes, taken out, shaken for 10 seconds and put back into water for another two minutes. The washed images showed very little dye fading. This is an indication of excellent waterfastness.

EXAMPLE 2 (CONTROL)

This Example illustrates that the excellent results achieved in Example 1 are not achieved using underivatized poly(vinyl alcohol) alone.

A dispersion was formed from the following components; all parts by weight are quoted on a dry solids basis:

| | Parts by weight |
|---|---|
| Underivatized poly(vinyl alcohol) (Airvol 205) | 65.8 |
| Terpolymer | 10.0 |
| Poly(vinyl pyrrolidone) | 22.0 |
| Poly(methyl methacrylate) | 2.0 |
| Surfactant (Plurafac C17) | 0.2 |

To prepare the dispersion, 230.3 grams of a 20 weight percent aqueous solution of Airvol 205 and 55.6 grams of a 12.6 weight percent aqueous solution of terpolymer were added to 485.2 grams of water, and mixed in a air-driven mixer for 30 minutes. The surfactant (1.4 grams of a 10 weight percent aqueous solution), poly(methyl methacrylate) (35 grams of a 4 weight percent aqueous dispersion) and the poly(vinyl pyrrolidone) (192.5 grams of an 8 weight percent aqueous solution) were then added, and the resultant mixture mixed for a further 30 minutes to produce a dispersion suitable for coating.

The dispersion thus produced was coated on to 7.6 mil polyclad photo paper using a #24 Mayer rod at a coating weight of 4.2 g/m$^2$, and the coated sheets were dried at 80° C. in an oven for 10 minutes. The dried ink jet recording sheets were tested using a Lexmark 2050 printer and were found to a soft, tacky image in black areas.

EXAMPLE 3 (CONTROL)

This Example illustrates that the excellent results achieved in Example 1 are not achieved using derivatized poly(vinyl alcohol) alone.

A dispersion was formed from the following components; all parts by weight are quoted on a dry solids basis:

| | Parts by weight |
|---|---|
| Acetoacetylated poly(vinyl alcohol) (Z200) | 65.8 |
| Terpolymer | 10.0 |
| Poly(vinyl pyrrolidone) | 22.0 |
| Poly(methyl methacrylate) | 2.0 |
| Surfactant (Plurafac C17) | 0.2 |

To prepare the dispersion, 575.75 grams of an 8 weight percent aqueous solution of Z200 and 55.6 grams of a 12.6 weight percent aqueous solution of terpolymer were added to 139.8 grams of water, and mixed in a air-driven mixer for 30 minutes. The surfactant (1.4 grams of a 10 weight percent aqueous solution), poly(methyl methacrylate) (35 grams of a 4 weight percent aqueous dispersion) and the poly(vinyl pyrrolidone) (192.5 grams of 8 weight percent aqueous solution) were then added, and the resultant mixture mixed for a further 30 minutes to produce a dispersion suitable for coating.

The dispersion thus produced was coated on to 7.6 mil polyclad photo paper using a #24 Mayer rod at a coating weight of 4.2 g/m$^2$, and the coated sheets were dried in an oven at 80° C. for 10 minutes. The dried ink jet recording sheets were tested using a Lexmark 2050 printer and were found to give color images with slight ink smearing and pooling.

We claim:

1. An ink jet recording sheet comprising a support carrying an ink-receiving layer, this ink-receiving layer comprising a non-derivatized poly(vinyl alcohol) and a derivatized poly(vinyl alcohol) in which at least some of the hydroxyl groups present in underivatized poly(vinyl alcohol) are replaced by ether or ester groupings, the weight ratio of the non-derivatized poly(vinyl alcohol) to the derivatized poly (vinyl alcohol) being in the range of about 2:1 to about 1:2.

2. An ink jet recording sheet according to claim 1 wherein the derivatized poly(vinyl alcohol) is an acetoacetylated poly(vinyl alcohol).

3. An ink jet recording sheet according to claim 1 wherein the poly(vinyl alcohols) are cross-linked.

4. An ink jet recording sheet according to claim 3 wherein the derivatized poly(vinyl alcohol) has been cross-linked with an aldehyde cross-linking agent.

5. An ink jet recording sheet according to claim 1 wherein the ink-receiving layer further comprises a poly(vinylbenzyl quaternary ammonium salt).

6. An ink jet recording sheet according to claim 5 wherein the poly(vinylbenzyl quaternary ammonium salt) is of the formula:

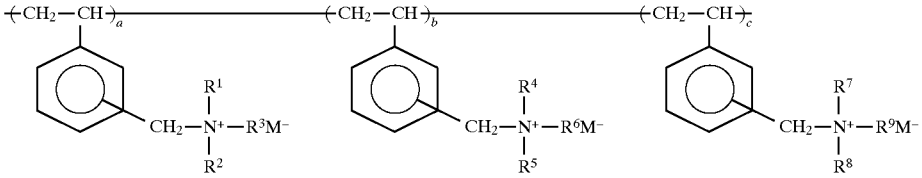

wherein each of $R^1$, $R^2$, $R^3$, $R^4$, $R^5$ and $R^6$ is independently alkyl of from 1 to 4 carbon atoms; each of $R^7$, $R^8$ and $R^9$ is independently alkyl of from 1 to 18 carbon atoms and the total number of carbon atoms in $R^7$, $R^8$ and $R^9$ is from 13 to 20; each $M^-$ is an anion; and each of a, b and c is the molar proportion of the respective repeating units.

7. An ink jet recording sheet according to claim 6 wherein each of $R^1$, $R^2$, $R^3$, $R^7$ and $R^8$ is a methyl group; each of $R^4$, $R^5$ and $R^6$ is an ethyl group; and $R^9$ is an n-$C_{12}H_{25}$ group.

8. An ink jet recording sheet according to claim 1 wherein the ink-receiving layer further comprises poly (vinylpyrrolidone).

9. An ink jet recording sheet according to claim 1 wherein the ink-receiving layer further comprises a poly(alkyl acrylate) or a poly(alkyl methacrylate).

10. An ink jet recording sheet according to claim 1 wherein the ink-receiving layer further comprises a surfactant.

11. An ink jet recording sheet according to claim 10 wherein the surfactant is a linear alkoxylated fatty alcohol surfactant.

12. An ink jet recording sheet according to claim 1 comprising substantially equal weights of the non-derivatized and derivatized poly(vinyl alcohol)s.

13. An ink jet recording sheet comprising a support carrying an ink-receiving layer, this ink-receiving layer comprising:

from about 20 to about 40 parts by weight of a non-derivatized poly(vinyl alcohol);

from about 20 to about 40 parts by weight of an acetoacetylated poly(vinyl alcohol);

the weight ratio of the non-derivatized poly(vinyl alcohol) to the acetoacetylated poly(vinyl alcohol) being in the range of about 2:1 to about 1:2 from about 5 to about 15 parts by weight of an a poly(vinylbenzyl quaternary ammonium salt);

from about 15 to about 30 parts by weight of poly (vinylpyrrolidone);

from 0 to about 5 parts by weight of a poly(alkyl acrylate) or poly(alkyl methacrylate); and from 0 to about 1 part by weight of a surfactant.

* * * * *